US007621123B2

(12) United States Patent
Jacobs et al.

(10) Patent No.: US 7,621,123 B2
(45) Date of Patent: Nov. 24, 2009

(54) ACTUATOR CONTROL SYSTEM AND METHOD

(76) Inventors: Michael H. Jacobs, 25 Old Coach Rd., Napa, CA (US) 94558; Kenneth Sean Cowan, 4780 Bluebird La., El Dorado, CA (US) 95623; Allen L. Rasmussen, 4028 Albert Cir., El Dorado Hills, CA (US) 95762

( * ) Notice: Subject to any disclaimer, the term of this patent is extended or adjusted under 35 U.S.C. 154(b) by 174 days.

(21) Appl. No.: 11/655,684

(22) Filed: Jan. 19, 2007

(65) Prior Publication Data

US 2007/0204603 A1 Sep. 6, 2007

Related U.S. Application Data

(60) Provisional application No. 60/760,572, filed on Jan. 20, 2006.

(51) Int. Cl.
*F15B 9/03* (2006.01)
*F04B 23/02* (2006.01)

(52) U.S. Cl. ..... 60/428; 60/431

(58) Field of Classification Search ..... 60/428, 60/431

See application file for complete search history.

(56) References Cited

U.S. PATENT DOCUMENTS 3,603,083 A * 9/1971 Coursen ..... 60/446
5,243,154 A * 9/1993 Tomisawa et al. ..... 187/286
5,522,479 A * 6/1996 Jo ..... 91/454
5,678,982 A * 10/1997 Schwaiger ..... 60/486
6,078,855 A * 6/2000 Kinugawa et al. ..... 60/431
6,247,559 B1 * 6/2001 Ach ..... 187/414
6,505,711 B1 * 1/2003 Zurcher et al. ..... 187/285
6,945,040 B2 * 9/2005 Kanno et al. ..... 60/431
6,971,481 B2 * 12/2005 Moser et al. ..... 187/285
7,080,508 B2 * 7/2006 Stavale et al. ..... 60/431

* cited by examiner

*Primary Examiner*—Thomas E Lazo
(74) *Attorney, Agent, or Firm*—Audrey A. Millemann; Weintraub Genshlea et al.

(57) ABSTRACT

Actuator control system and method comprising an electric motor driving a hydraulic pump in fluid delivery communication with a source of hydraulic fluid; a variable speed controller operatively coupled to the motor for driving the pump at variable speeds; an external hydraulic actuator in fluid delivery communication with the pump for receiving pressurized fluid flow from the pump; and a feedback loop operatively coupled from the motor to the controller for providing feedback signals correlative to a pressure of the pressurized fluid flow through the driven pump for driving the external hydraulic actuator in response to the feedback signals for providing electronic velocity and force control of actuation of the external hydraulic actuator. The actuator control system and method can operate on one or many high-pressure hydraulic linear and/or rotary actuators on different pieces of hydraulically driven equipment and with different velocity requirements actuating in different directions.

2 Claims, 21 Drawing Sheets

ACTUATOR CONTROL SYSTEM AND METHOD

CROSS-REFERENCE TO RELATED APPLICATION

This application claims priority to U.S. Provisional Patent Application No. 60/760,572, filed Jan. 20, 2006, the entire disclosure of which is incorporated herein by reference.

FIELD OF THE INVENTION

This invention relates generally to an actuator control system and method and, in particular, to an electronic variable speed (EVS) actuator control system and method for electronic velocity and force control of actuation of high-pressure hydraulic linear and/or rotary actuators.

BACKGROUND OF THE INVENTION

Current systems and methods for generating velocity and force using hydraulics as the transmission medium have numerous problems.

For example, commonly used centralized high pressure hydraulic systems are designed for plant wide use which requires complex and expensive high pressure hydraulic piping networks to the point of use. Thus, the installation of this piping network is both time consuming and laborious thereby resulting in a major expense and an operational problem that causes schedule delays. Costly power losses through the piping network are also significant. There is also a problem with leaking pipe joints and connections that waste power and create operational hazards. Hence, the piping network often costs more than the operational components.

Current centralized high pressure hydraulic systems also require large oil reservoirs with hydraulic filtration and oil cooling components, expensive high-pressure hydraulic pumps that sense the load requirements and adjust the velocity of linear or rotary actuators, expensive high-pressure hydraulic valves used to limit horsepower and control the force and velocity of hydraulic actuators, high-pressure hydraulic directional valves to control the direction of movement of the linear or rotary hydraulic actuators, and expensive remote sensing devices that signal the velocity of the linear or rotary hydraulic actuators.

Hence, current centralized high pressure hydraulic systems require considerable physical space for both the placement of the central system and the associated piping. Many times a specific room is utilized or required to enclose the central system.

Furthermore, current centralized high pressure hydraulic systems and methods utilize electric motors as a "prime mover" which are repeatedly started and stopped thereby creating a large electric current draw which increases the system acquisition cost as well as operational cost. Alternatively, the electric motors run constantly, most often in a "stand-by" mode wasting electric power and causing wear on system components. Thus, the velocity and force control with current methods involves complex systems that generate heat and waste horsepower.

Moreover, current centralized high pressure hydraulic systems and methods, in many applications, require feedback signals to travel long distances often resulting in system failure.

For the foregoing reasons, there is a need for a system and method for the velocity and force control of actuation of high-pressure hydraulic linear and/or rotary actuators that overcomes the significant shortcomings of the known prior-art as delineated hereinabove.

BRIEF SUMMARY OF THE INVENTION

In general, and in one aspect, an embodiment of the invention provides an EVS actuator control system which is contained in a standard NEMA electrical enclosure for providing a compact point-of-use EVS actuator control system which can be located on or close to the equipment being operated thereby eliminating centralized high-pressure hydraulic systems and costly high-pressure plant wide hydraulic plumbing.

In another aspect, an embodiment of the invention provides an EVS actuator control system which is a cost effective energy management device that operates on demand and can operate one or many actuators on different pieces of hydraulically driven equipment and with different velocity requirements actuating in different directions. Thus, there is a significant cost savings versus using prior conventional hydraulic systems that require sophisticated hydraulic valves and remote sensors to accomplish control.

In another aspect, an embodiment of the invention provides an EVS actuator control system which can increase the speed range of a typical electric motor and which can vary, for example, the speed from 800 to 4,000 RPM while driving a high-pressure hydraulic pump. Hence, the EVS actuator control system controls the speed of the electric motor driving the high-pressure hydraulic pump such that the electric motor controls the output flow of the high-pressure hydraulic pump and thereby controls the velocity of the linear or rotary actuator.

In another aspect, an embodiment of the invention provides an EVS actuator control system which can operate linear or rotary gates and valves, hoppers, lifts, compactors or virtually any piece(s) of hydraulic equipment requiring intermittent operation where controlled velocity and force of the actuation is desirable thereby replacing centralized high-pressure hydraulic systems where intermittent operation is required to operate high-pressure hydraulic linear or rotary actuators.

In another aspect, an embodiment of the invention provides multiple plant wide EVS actuator control systems for providing a cost effective solution compared to a prior central hydraulic system and the associated high-pressure hydraulic plant wide plumbing.

In particular, and in one embodiment, the actuator control system comprises: a source of hydraulic fluid; a pump in fluid delivery communication with the source of hydraulic fluid; an electric motor operatively coupled to the pump for driving the pump for supplying a pressurized fluid flow of hydraulic fluid from the source of hydraulic fluid; a solenoid operated directional valve in fluid delivery communication with the pump for receiving the pressurized fluid flow of hydraulic fluid supplied from the pump and allowing the pressurized fluid flow through the solenoid operated directional valve upon operation thereof; a hydraulic actuator in fluid delivery communication with the pressurized fluid flow through the solenoid operated directional valve for moving a member of the hydraulic actuator at a velocity and force upon operation of the solenoid operated directional valve; a variable speed controller operatively coupled to the electric motor; and a motor feedback loop operatively coupled from the electric motor to the variable speed controller for providing feedback signals correlative to a pressure of the pressurized fluid flow for driving the member of the hydraulic actuator in response to the feedback signals for providing electronic velocity and force control of actuation of the member of the hydraulic actuator. In one embodiment, the actuator control system further includes a common enclosure enclosing the source of hydraulic fluid; the pump; the electric motor; the solenoid operated directional valve; the variable speed controller; and the motor feedback loop. The hydraulic actuator is external to the common enclosure.

Additionally, and in one embodiment, the actuator control system comprises in combination: a reservoir of hydraulic fluid providing a source of hydraulic fluid; a pump mounted in fluid delivery communication with the source of hydraulic fluid; an electric motor operatively coupled to the pump for driving the pump for supplying a fluid flow of hydraulic fluid from the source of hydraulic fluid; a variable speed controller operatively coupled to the electric motor for driving the electric motor at variable speeds; a hydraulic actuator in fluid delivery communication with the pump for receiving the fluid flow from the pump; and a feedback loop operatively coupled from the electric motor to the variable speed controller for providing feedback signals from the motor to the variable speed controller for intermittently driving the motor between a first low torque and high velocity state in response to the feedback signals being correlative to a low load being placed on the hydraulic actuator and a second high torque and low velocity state in response to the feedback signals being correlative to a high load condition being placed on the hydraulic actuator.

Furthermore, and in one embodiment, the actuator control method for controlling at least one hydraulic actuator comprises the steps of: driving a pump in fluid delivery communication with a source of hydraulic fluid with an electric motor for supplying a pressurized fluid flow of hydraulic fluid from the driven pump; controlling a running speed of the electric motor as a function of feedback signals from the motor correlative to a pressure of the pressurized fluid flow through the driven pump; providing a high-pressure hydraulic actuator in fluid delivery communication with the pump for receiving the pressurized fluid flow of hydraulic fluid from the pump; and driving the high-pressure hydraulic actuator at a variable velocity in response to the feedback signals correlative to the pressure of the pressurized fluid flow through the driven pump for controlling a velocity and force of actuation of the hydraulic actuator.

Accordingly, it should be apparent that numerous modifications and adaptations may be resorted to without departing from the scope and fair meaning of the claims as set forth herein below following the detailed description of the invention.

DETAILED DESCRIPTION OF THE INVENTION

Figure 1:
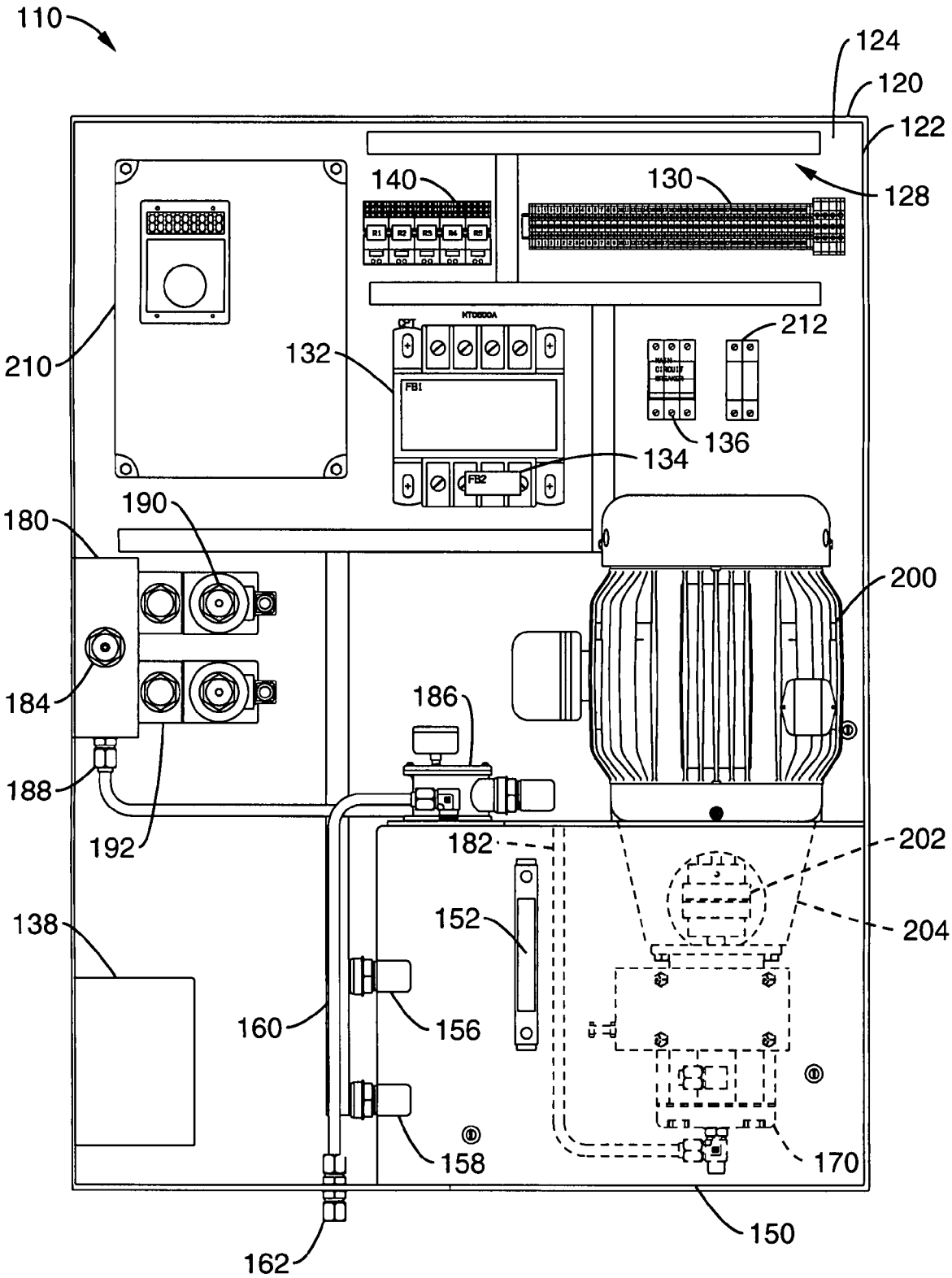
FIG. 1 is a front plane view of an electronic variable speed (EVS) actuator control system housed in a common enclosure with a front covered removed therefrom.

Considering the drawings, wherein like reference numerals denote like parts throughout the various drawing figures, reference numeral 110 is directed to an electronic variable speed (EVS) actuator control system.

In general, and referring to FIGS. 1 through 4, an embodiment of the invention provides an electronic variable speed (EVS) actuator control system 110 enclosed in a NEMA electrical enclosure 120 and powered from an external power supply 300 for providing electronic velocity and force control of actuation of at least one external high-pressure hydraulic linear and/or rotary actuator 400 working on work piece 410. The electrical enclosure 120 is comprised of a four sided construct 122 extending substantially perpendicularly between a back cover 124 and a front cover 126 wherein an internal cavity 128 is defined by the four sided construct 122 and back cover 124 and is accessible through front cover 126 shown in FIG. 2. The NEMA electrical enclosure 120 can be mounted on a wall or directly on a piece of equipment being operated via tabs 129 also shown in FIG. 2. The NEMA electrical enclosure 120 protects the EVS actuator control system 110 from the operating environment.

Figure 2:
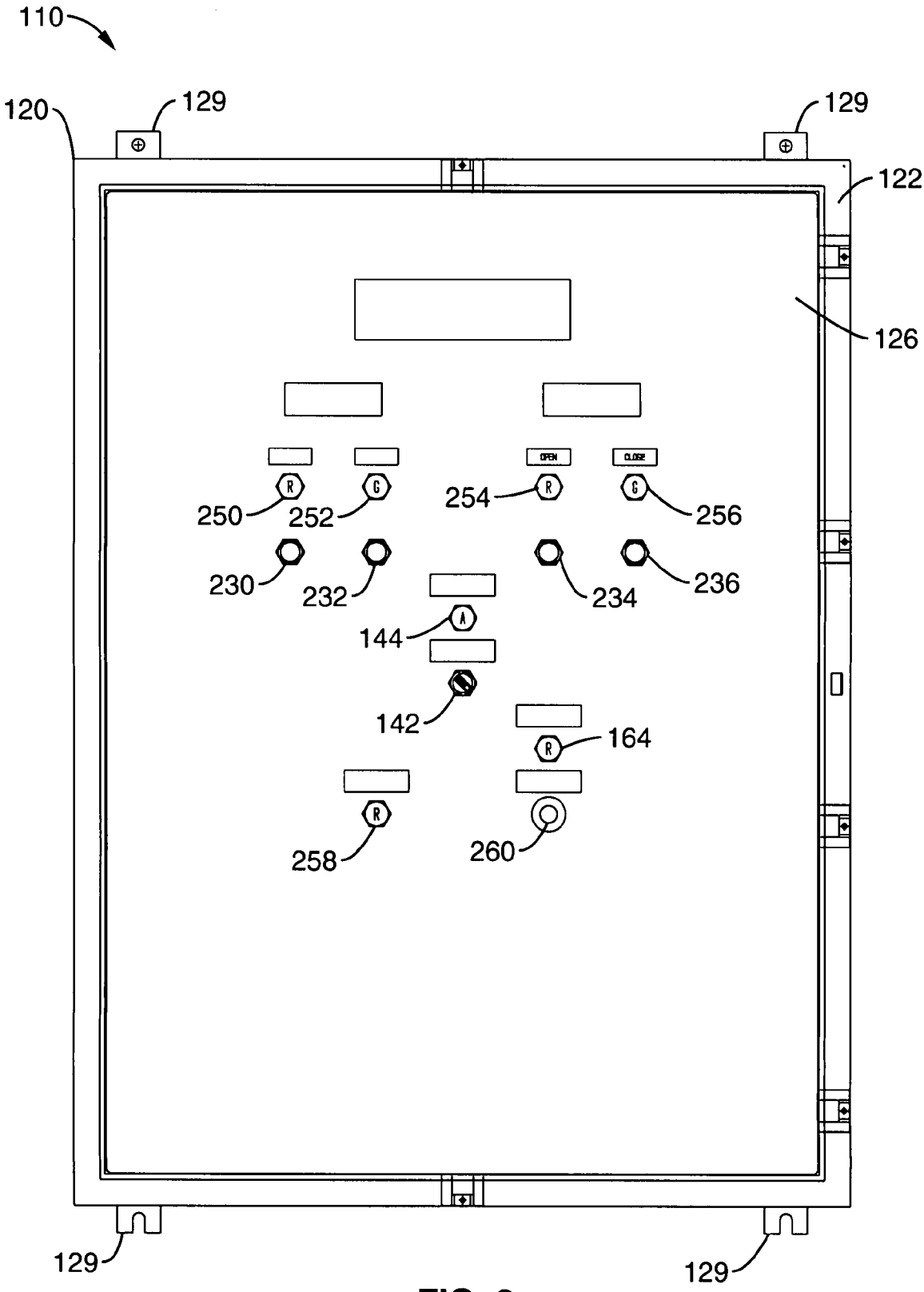
FIG. 2 is a front plane view of the electronic variable speed (EVS) actuator control system housed in the common enclosure with the front covered shown in a closed position.
Figure 5:
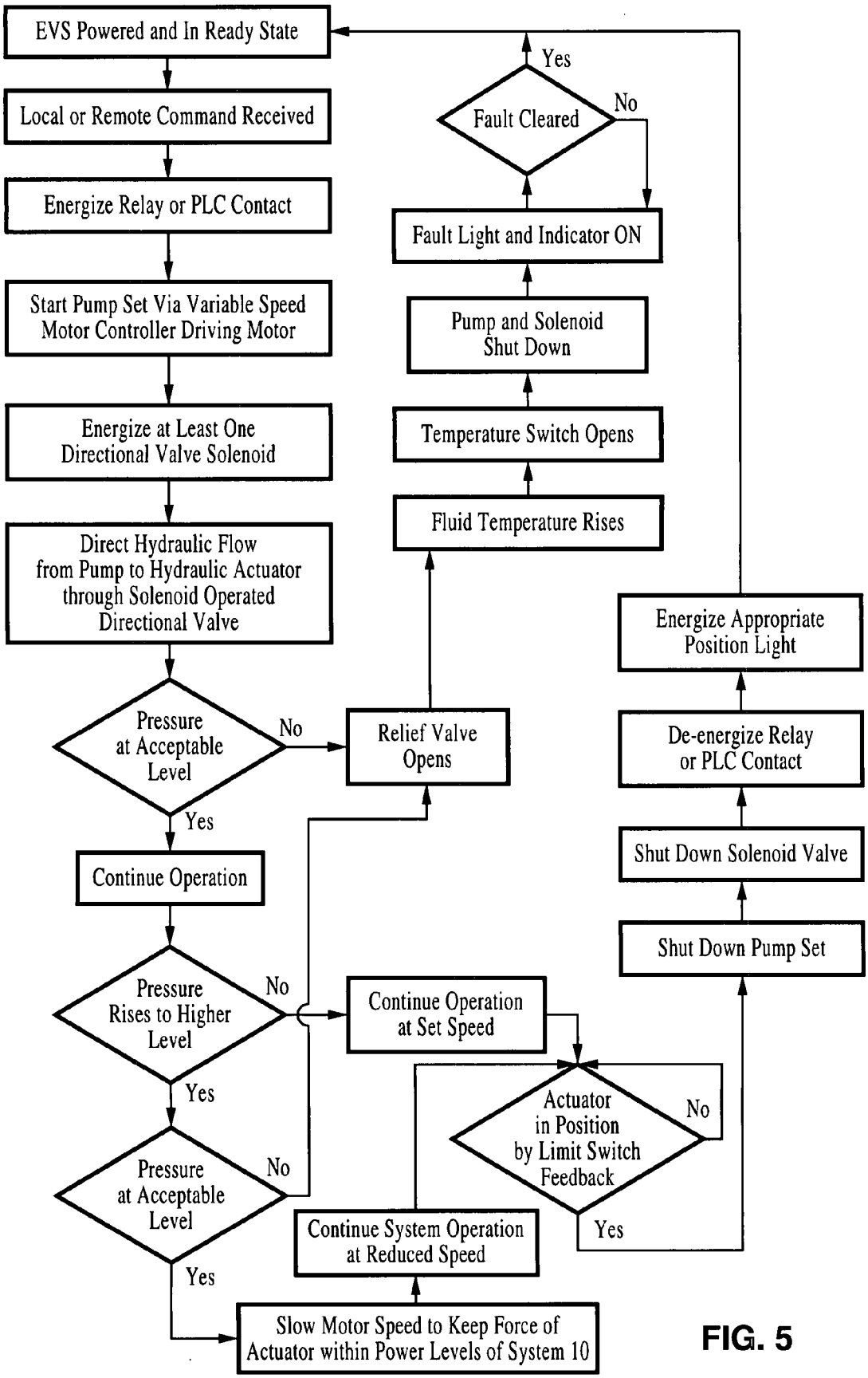
FIG. 5 is a functional flow diagram of a method of an embodiment of the electronic variable speed (EVS) actuator control system.
Figure 6:
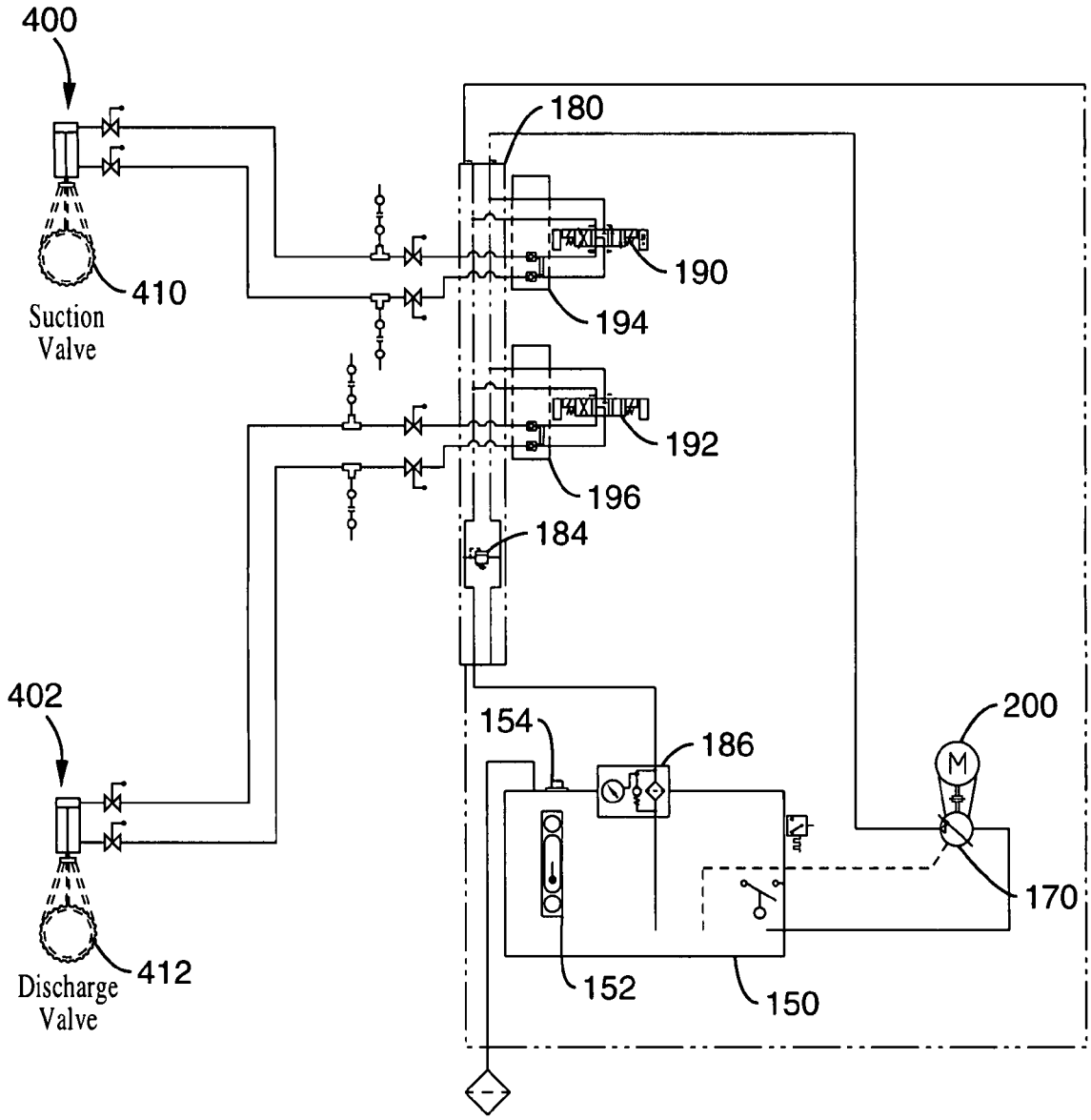
FIG. 6 is a hydraulic schematic of an embodiment of a hydraulic controller for the electronic variable speed (EVS) actuator control system.
Figure 7:
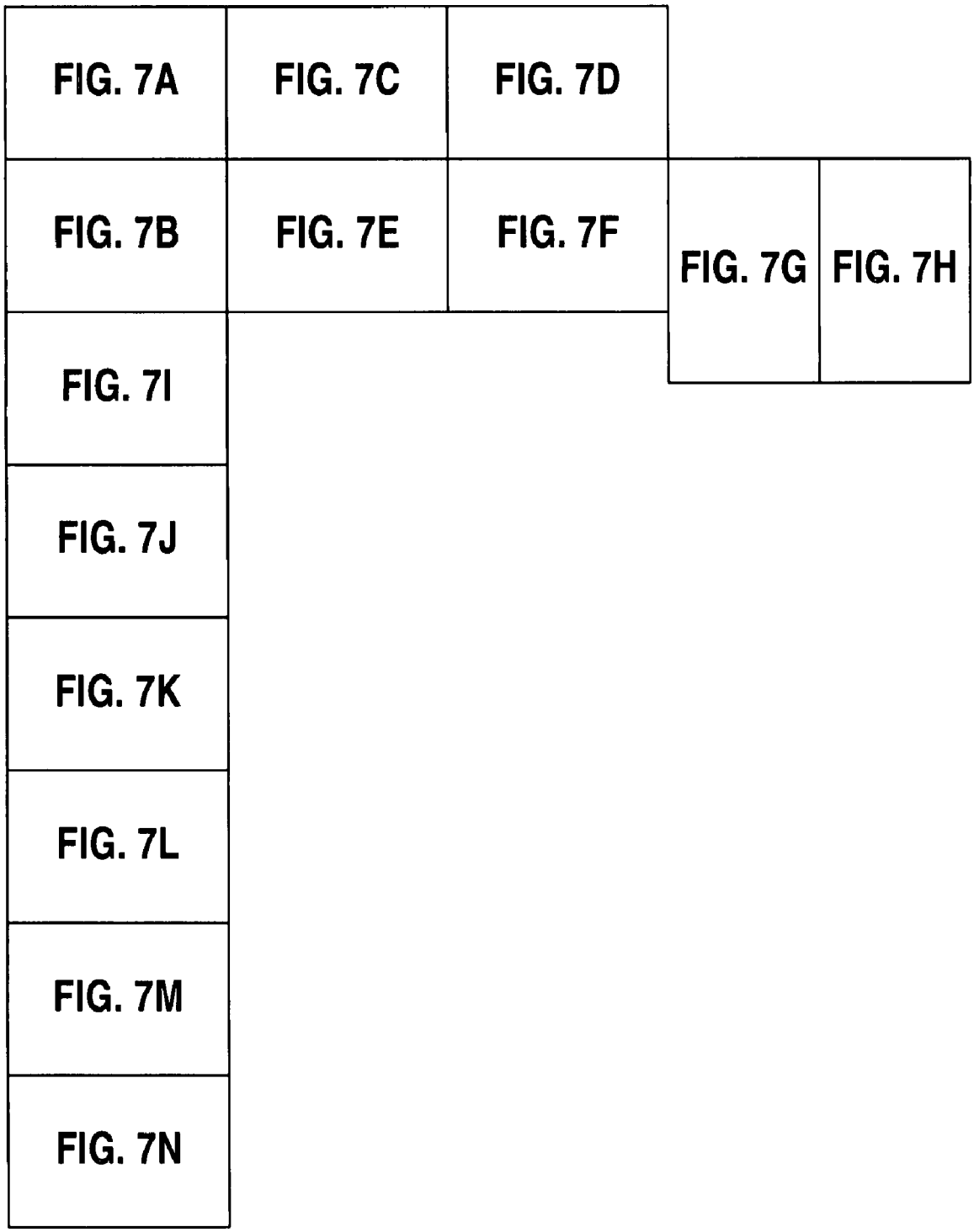
FIG. 7 is an electrical schematic of an embodiment of an electronic controller for the electronic variable speed (EVS) actuator control system.
Figure 7A:
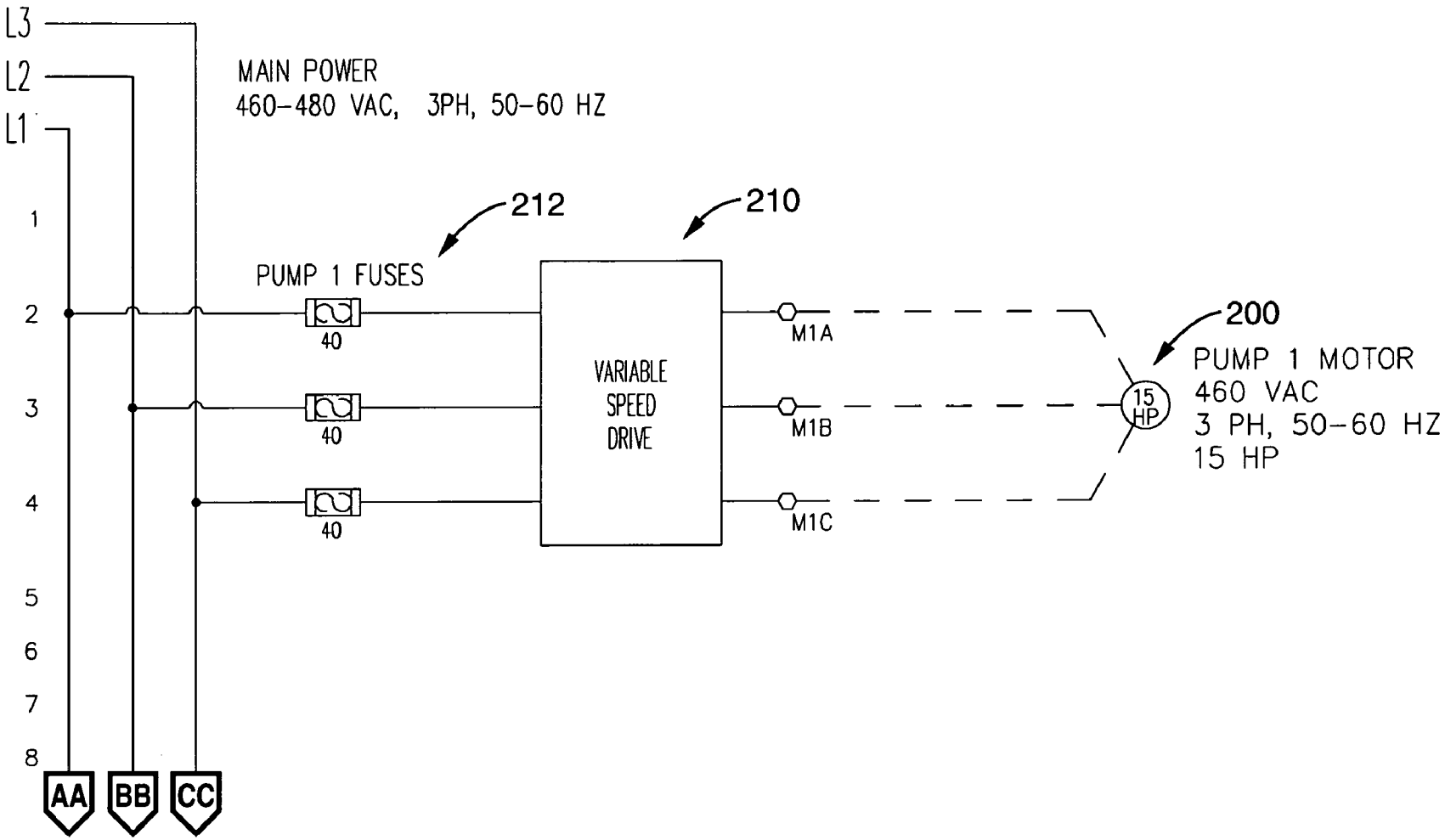
Figure 7B:
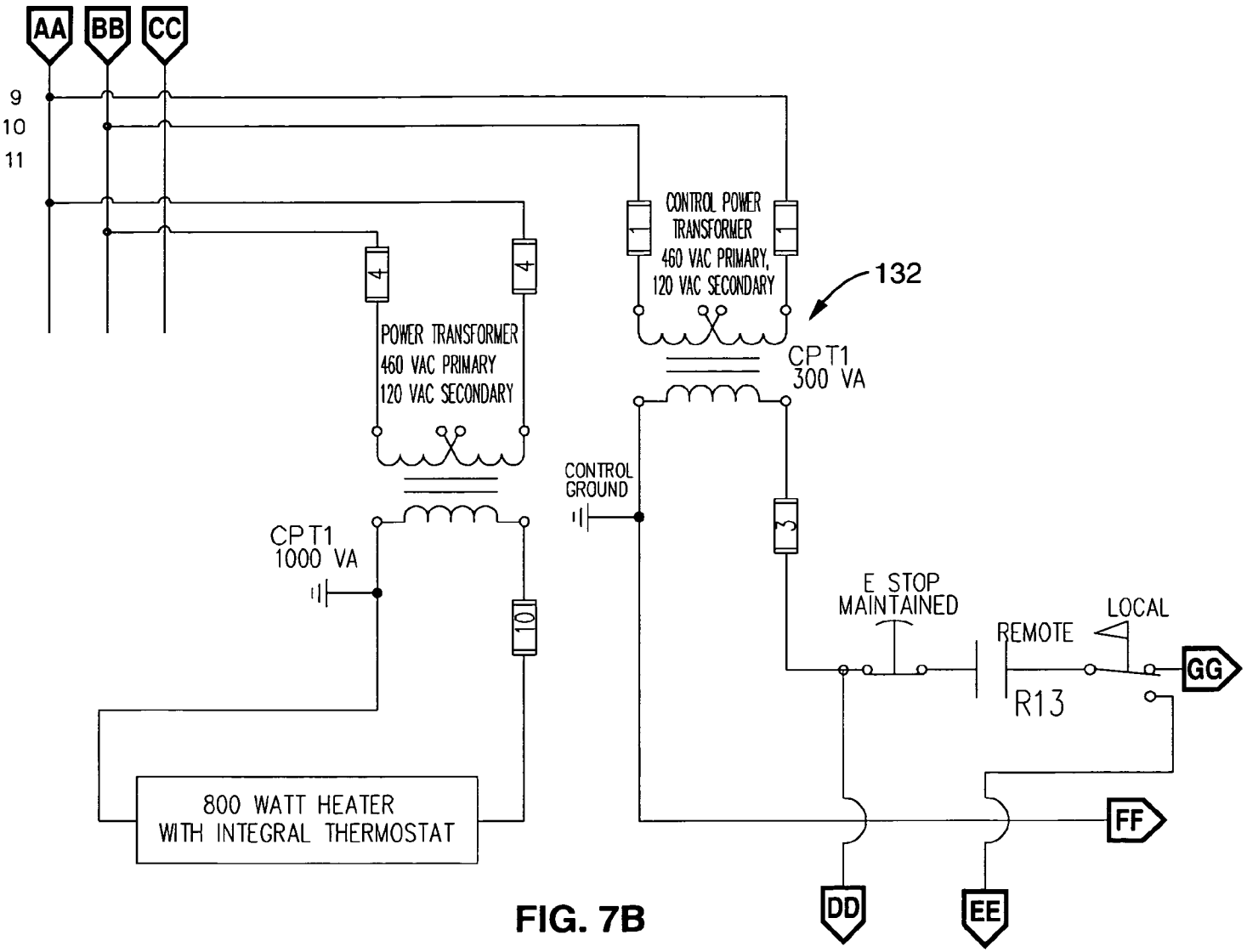
Figure 7C:
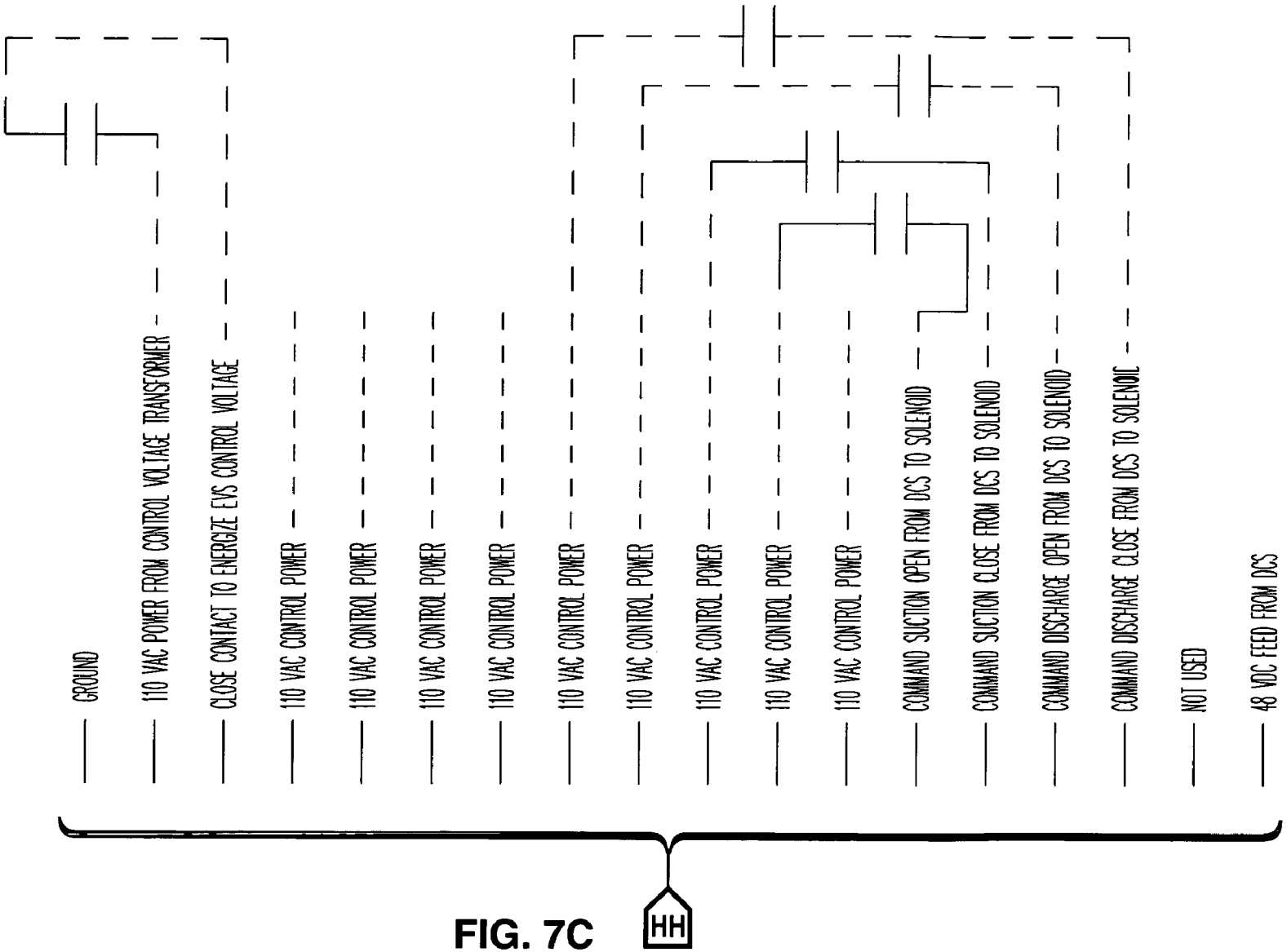
Figure 7D:
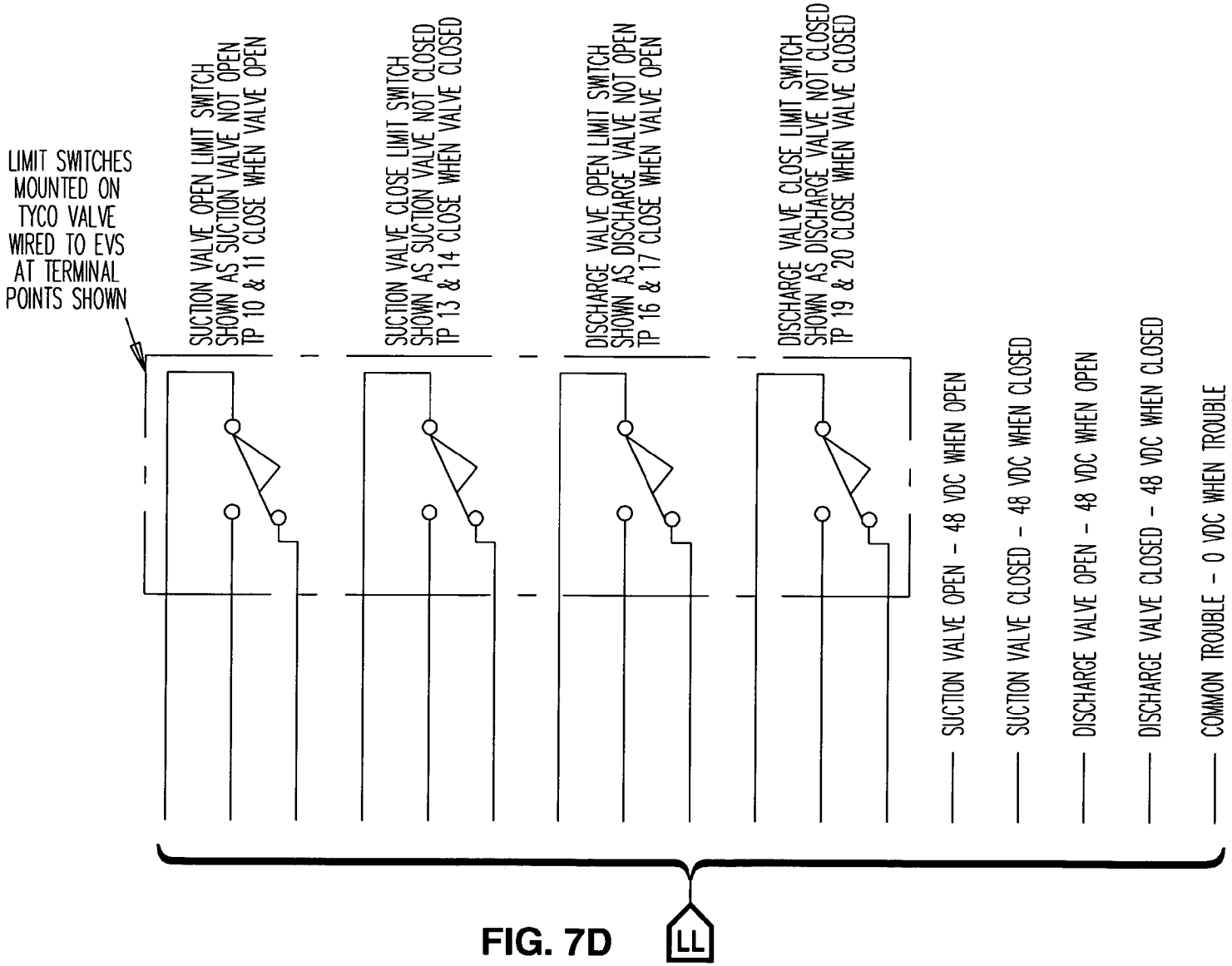
Figure 7E:
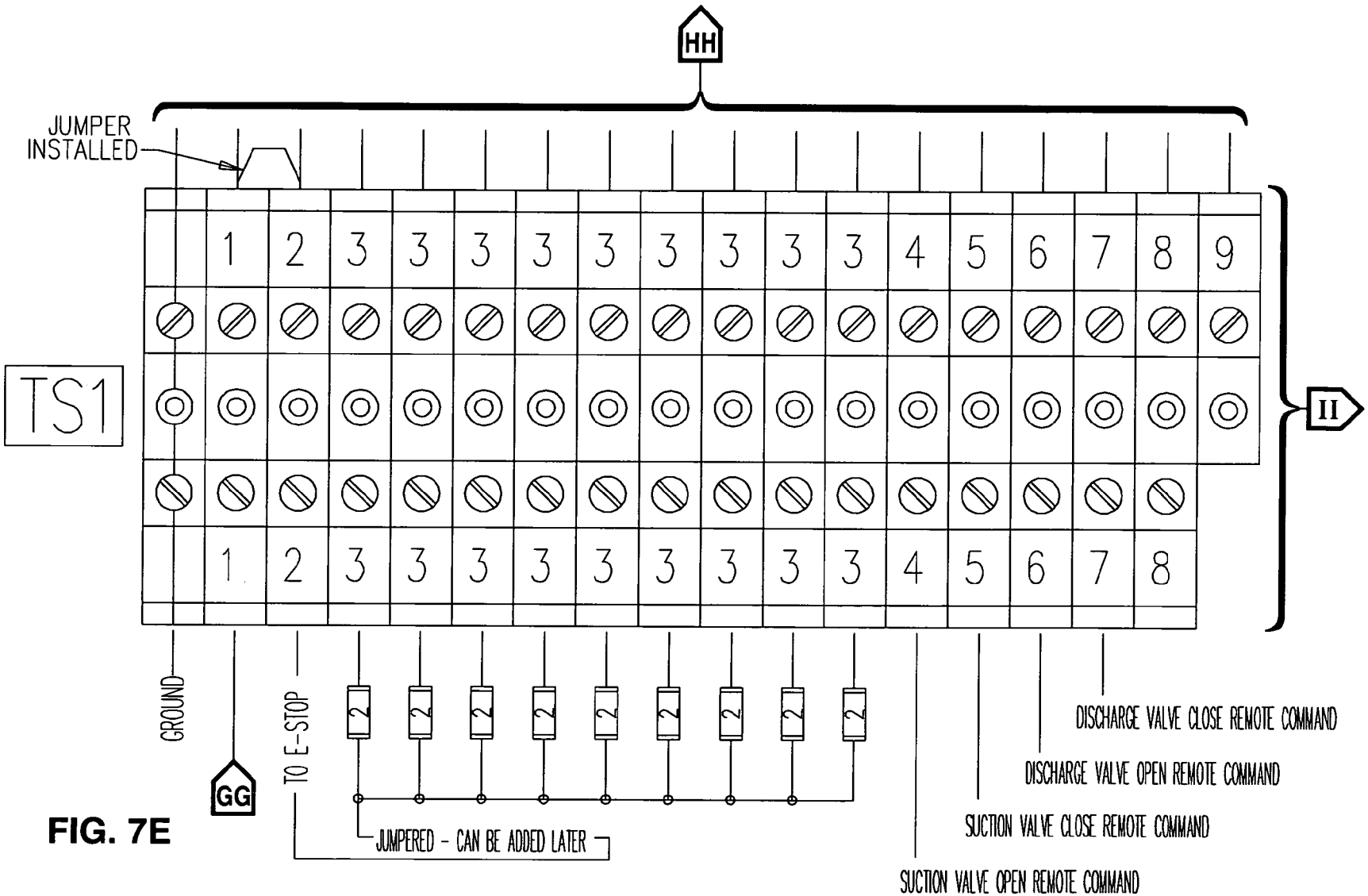
Figure 7F:
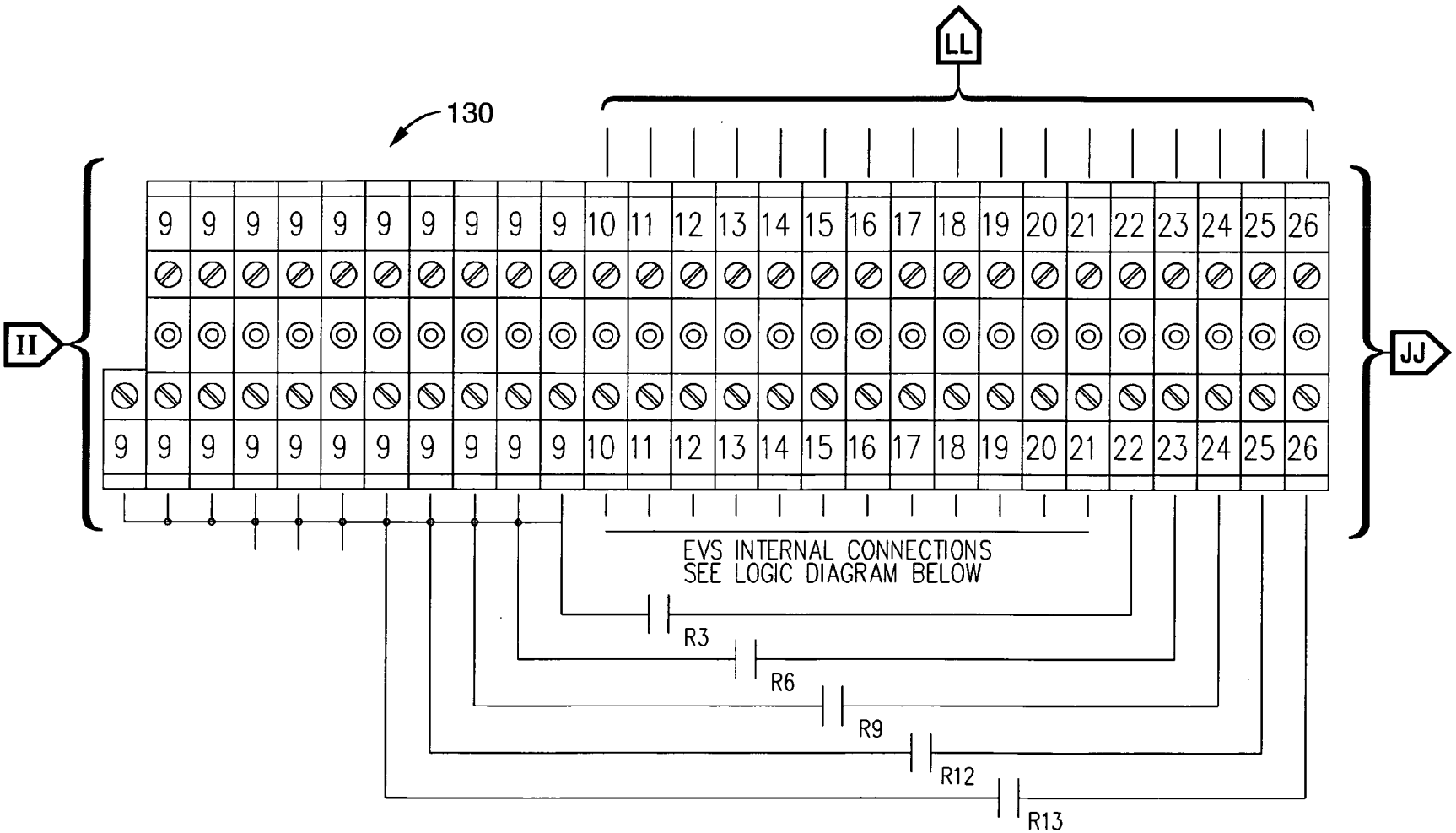
Figure 7G:
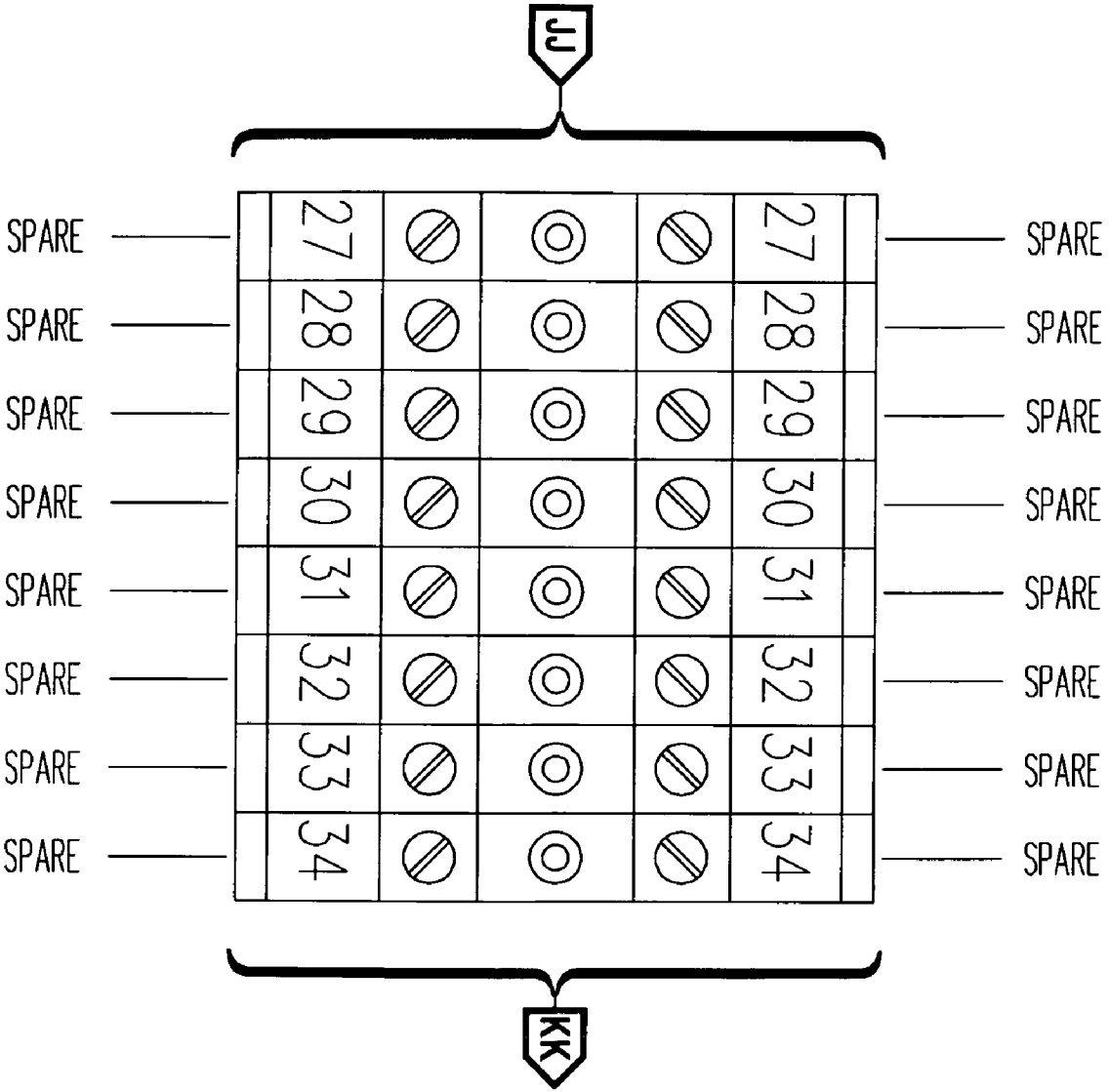
Figure 7H:
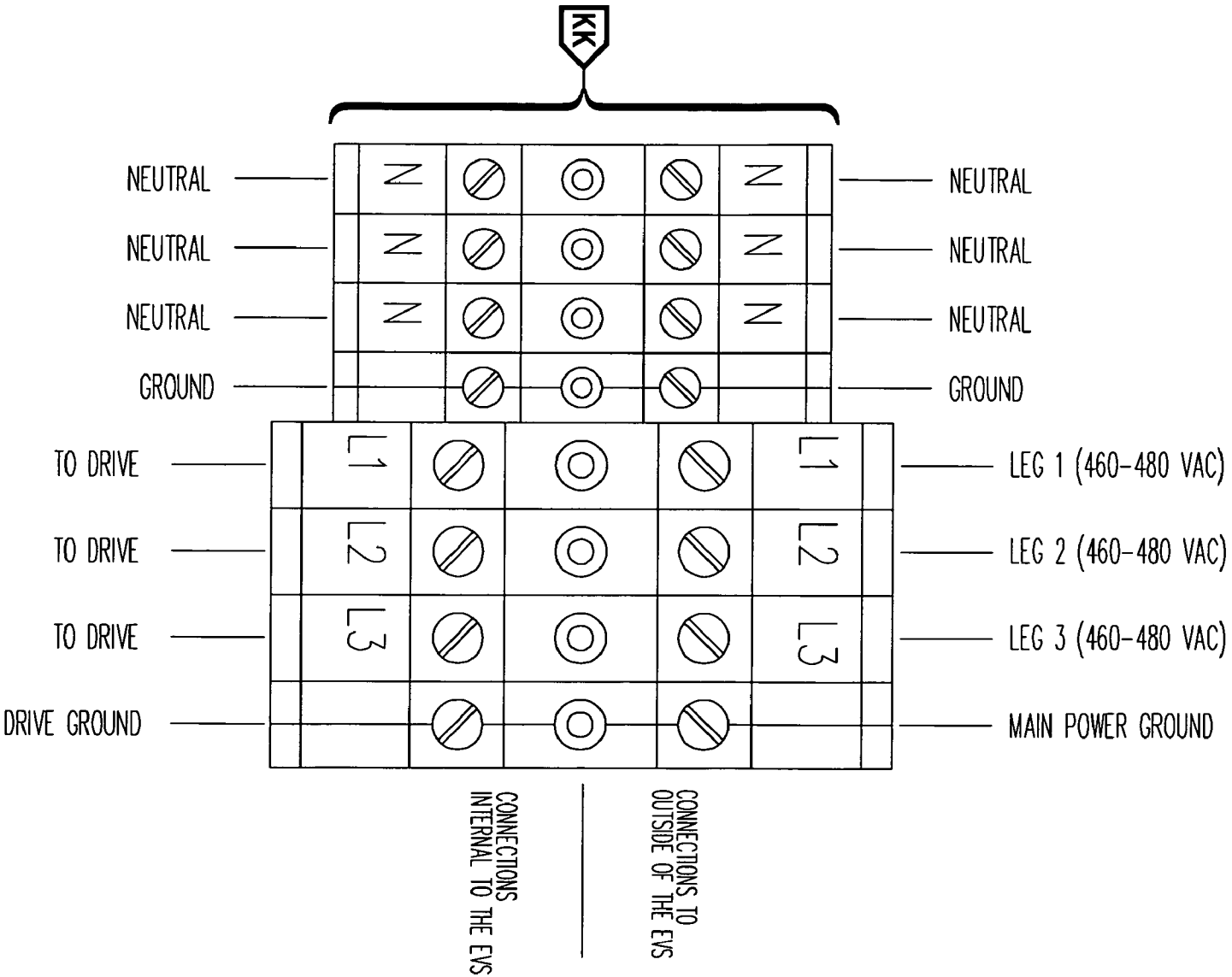
Figure 7I:
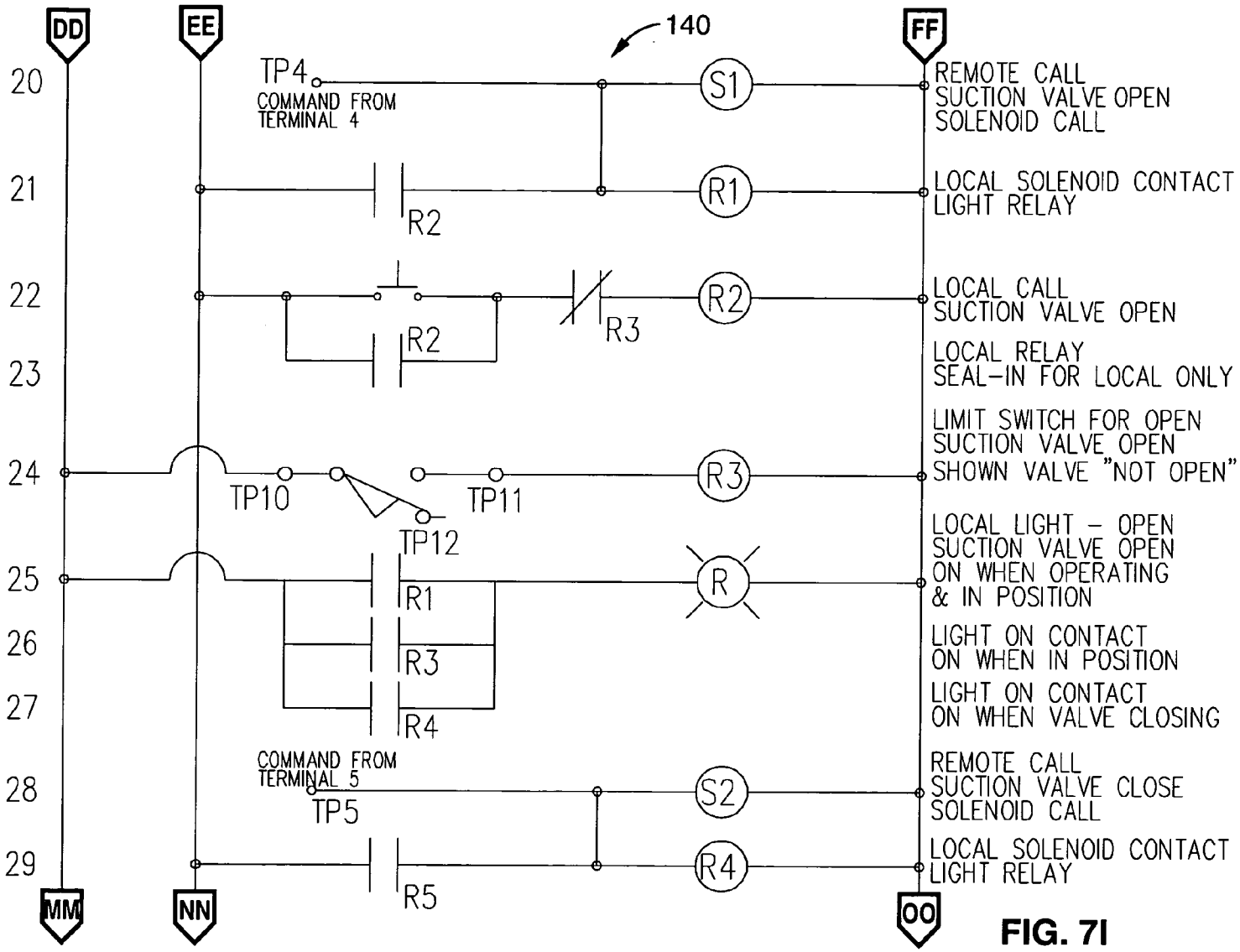
Figure 7J:
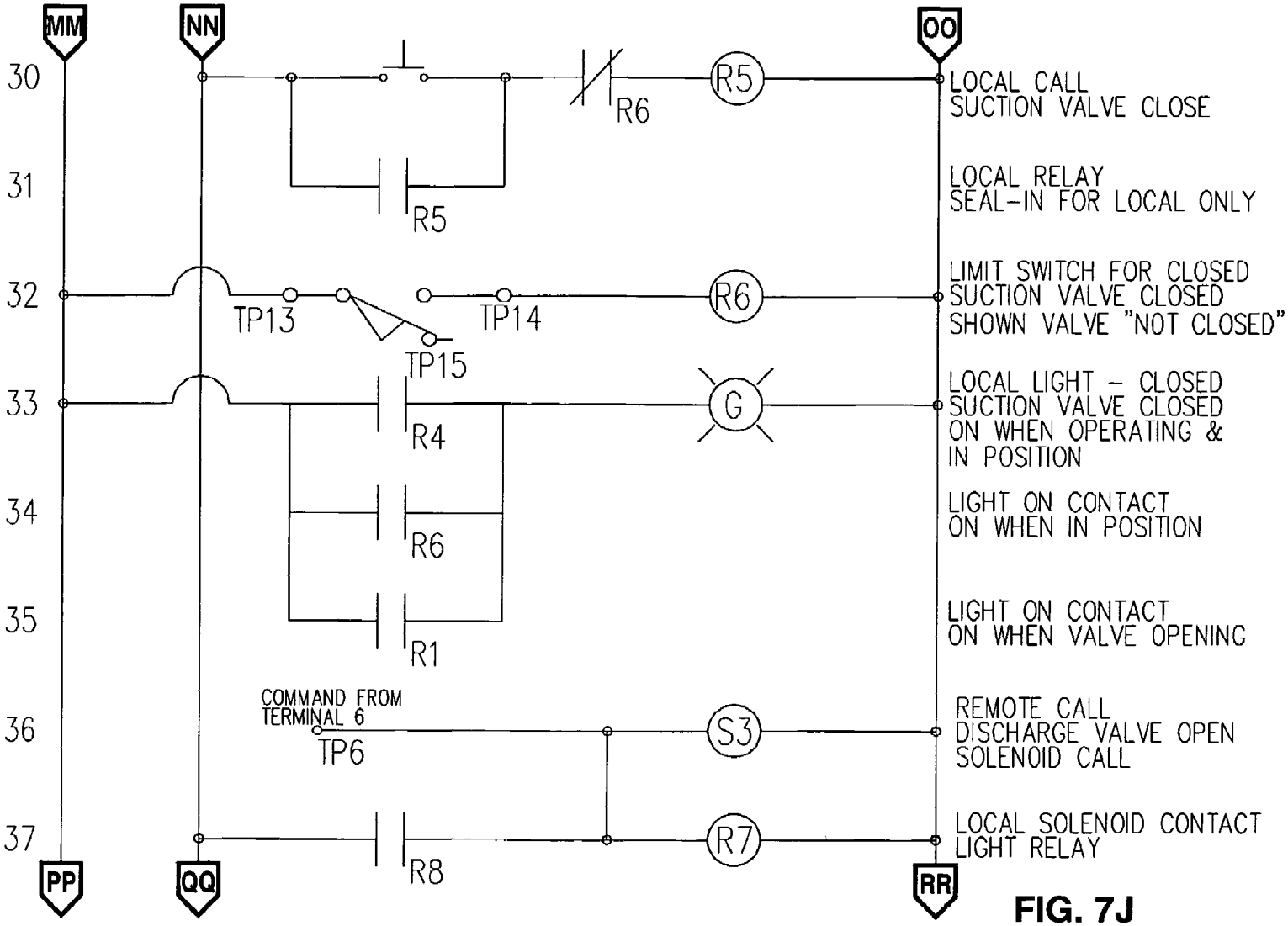
Figure 7K:
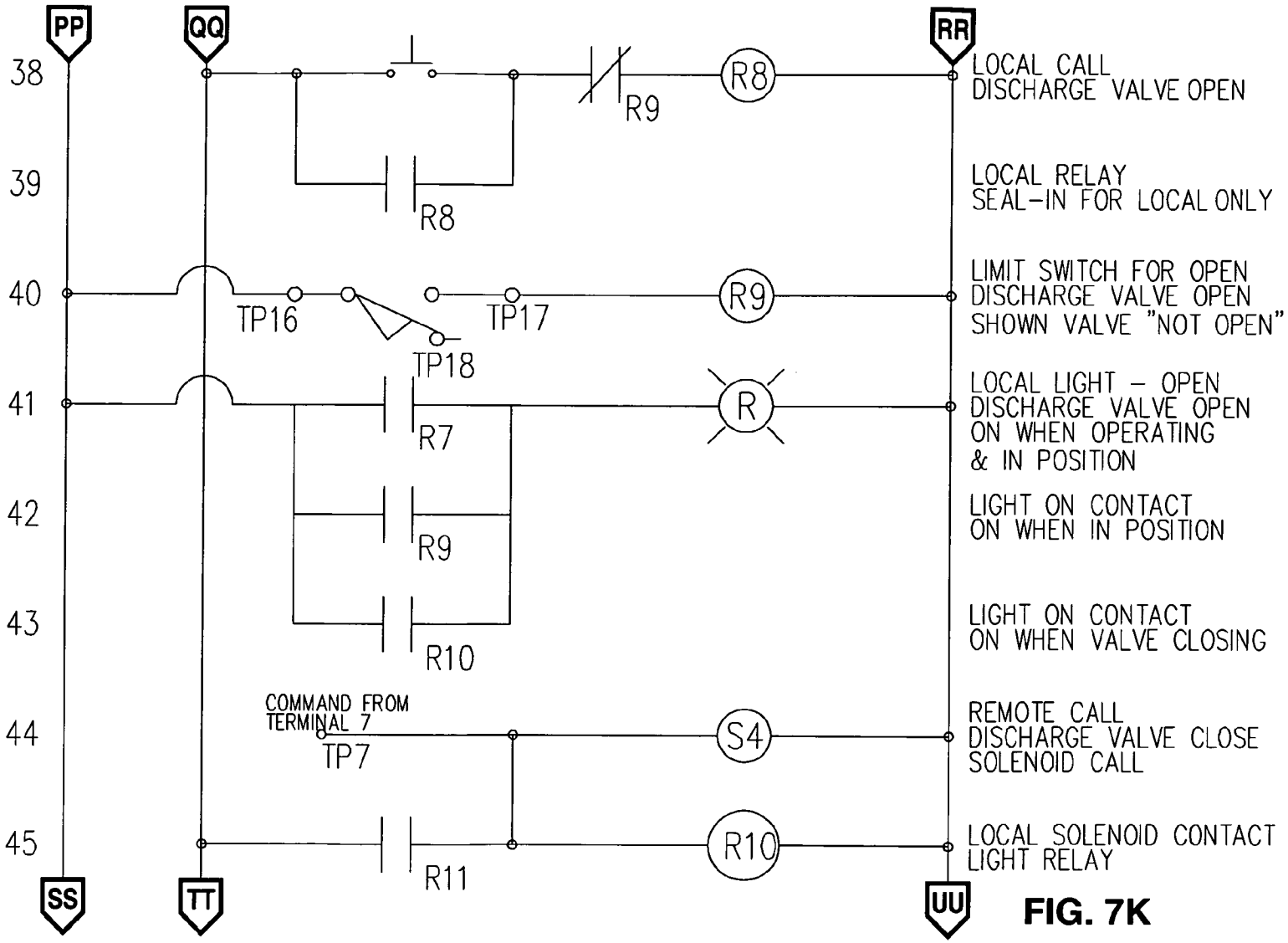
Figure 7L:
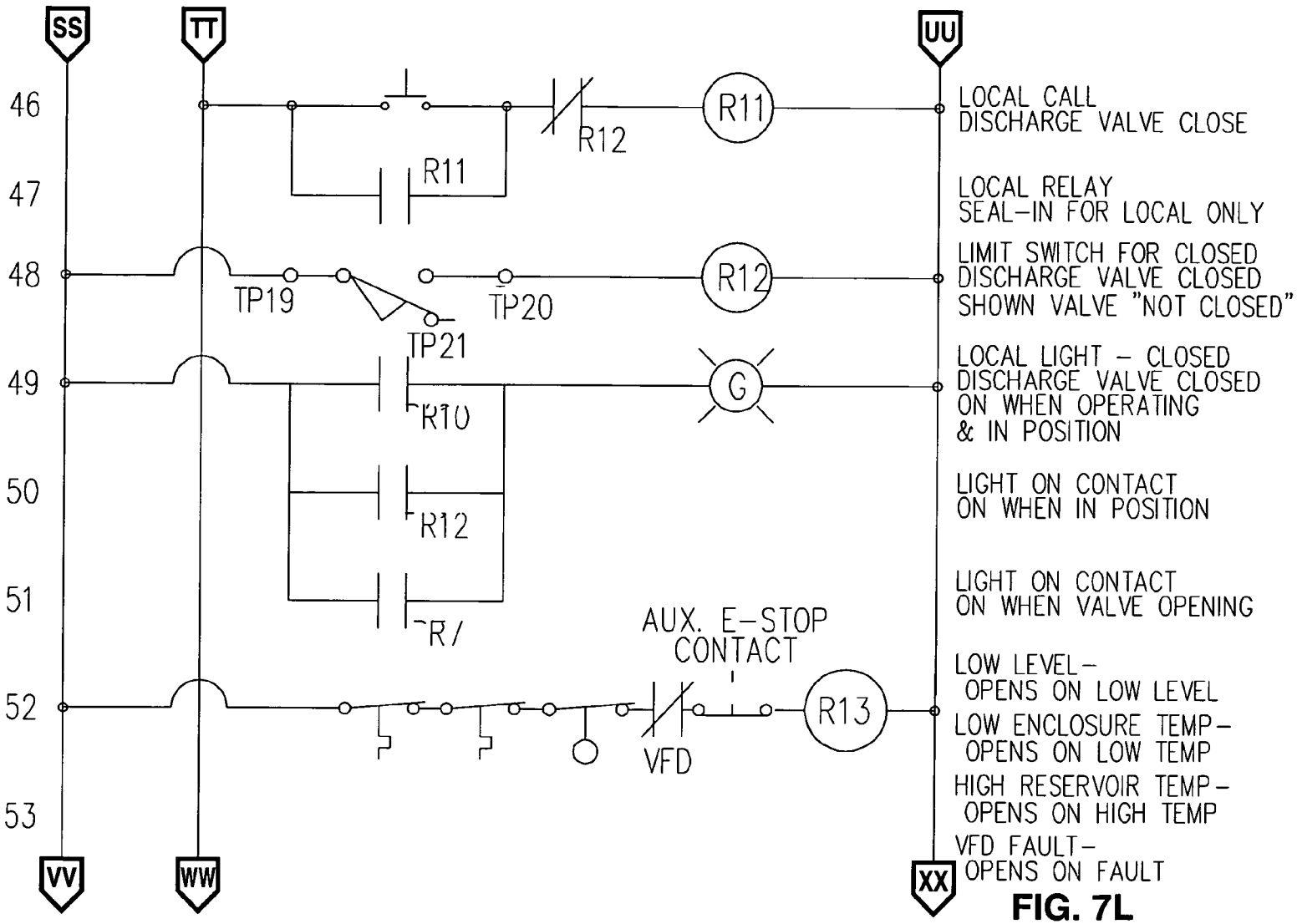
Figure 7M:
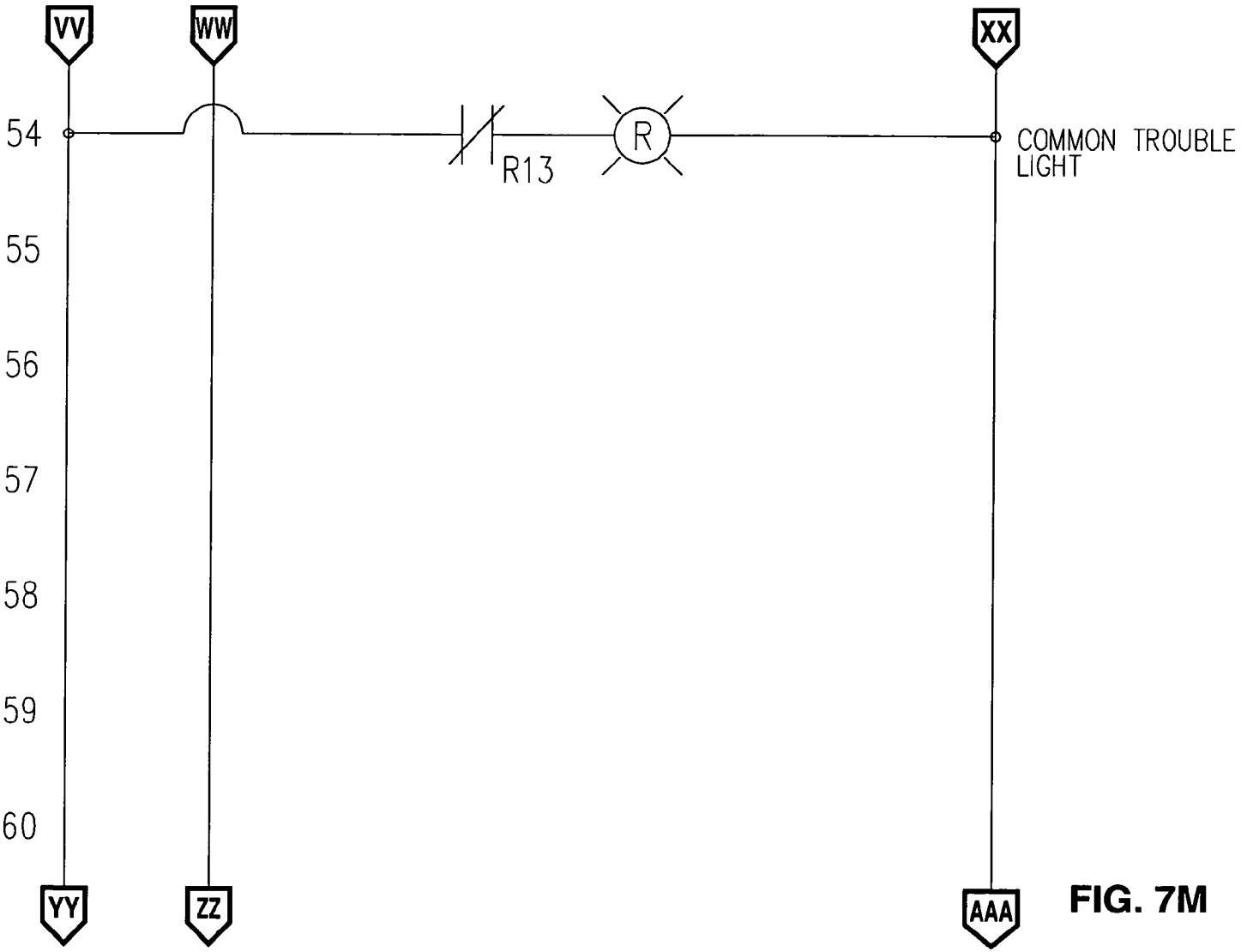
Figure 7N:
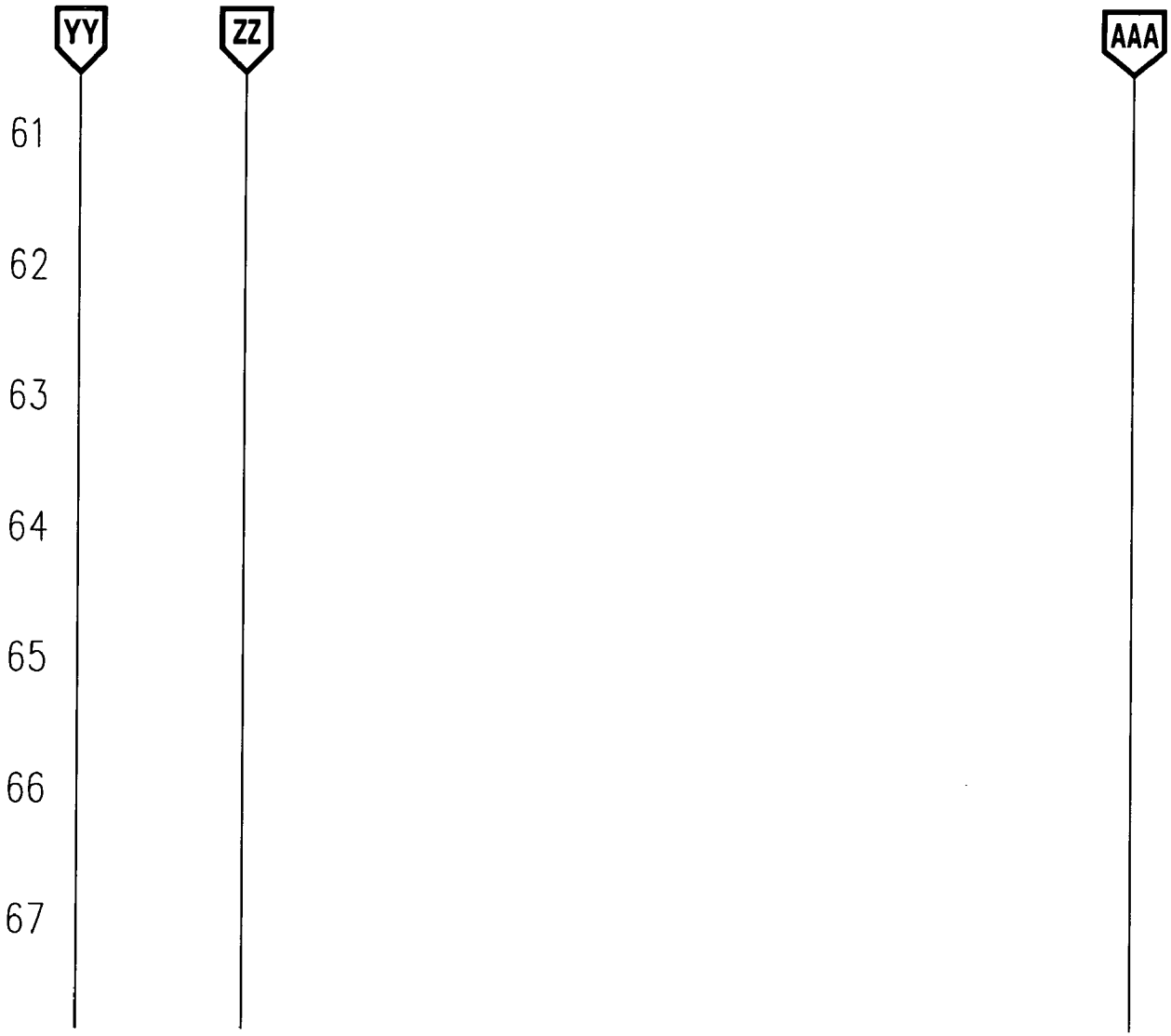

More specifically, and referring to FIGS. 1 through 7, an embodiment of the EVS actuator control system 110 is contained by the electrical enclosure 120 and is comprised of: a main DIN rail connection block 130 including wiring to connect all electrical connections and electrically connected to the external power supply 300 via connections L1, L2, and L3 as shown in FIG. 7, a control power transformer 132 electrically connected to the connection block 130 for receiving power from the external power supply 300, a transformer fuse 134 for protecting the control power transformer 132 based on power requirements, a main circuit breaker 136 for disconnecting the system 110 from the external power supply 300, an enclosure heater 138 electrically connected to the connection block 130 for receiving power from the external power supply 300, and a relay or PLC electronic system controller 140 electrically connected to the connection block 130 via a local/remote switch 142 shown in FIG. 2 for providing local system control when the local/remote switch 142 is in a local setting. The local/remote switch 142 can also be connected to a remote electronic system controller such as a plant wide Distributed Control System (DCS) 310 for providing remote system control when the local/remote switch 142 is in a remote setting indicated by illumination of a light 144 connected to connection block 130. The EVS actuator control system 110 can also be connected to communicate with a remote Internet or Dial-Up connection 312.

Additionally, and in one embodiment, the EVS actuator control system 110 is further comprised of: a reservoir 150 providing a source of hydraulic fluid, a fluid level sight glass 152 for sighting the hydraulic fluid level in the reservoir 150, a fill plug 154 shown in FIG. 6 for filling the reservoir 150 when necessary, a hydraulic oil temperature switch 156 mounted within the reservoir 150 and electrically connected to the connection block 130 for monitoring reservoir fluid temperature, a low level switch 158 mounted within the reservoir 150 and electrically connected to the connection block 130 for detecting a low fluid level condition in reservoir 150, a reservoir air breather tube 160 having one end connected to the reservoir 150 and an opposing end connected to an external reservoir air breather 162, and a fault light indicator 164 mounted on the front cover 126 of the enclosure 120 as shown in FIG. 2 and electrically connected to the connection block 130 for turning on as a result of an opening of the oil temperature switch 156 and/or an opening of the low level switch 158.

Figure 3:
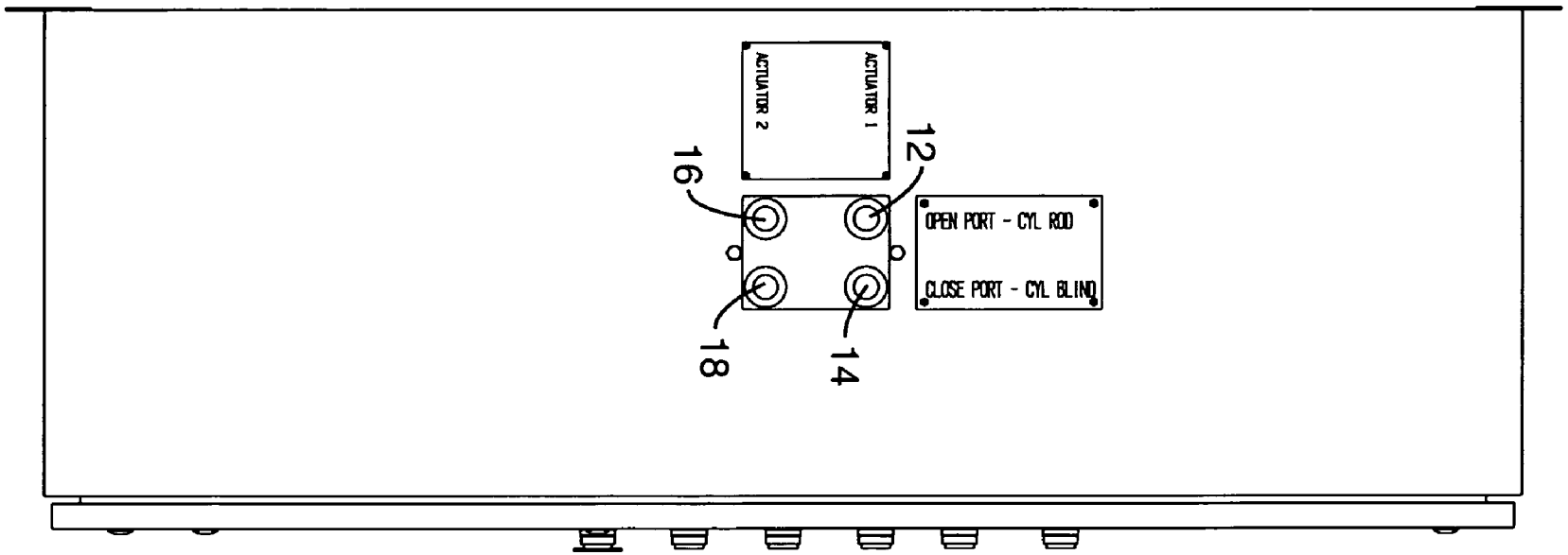
FIG. 3 is a side plane view of the electronic variable speed (EVS) actuator control system housed in the common enclosure.
Figure 4:
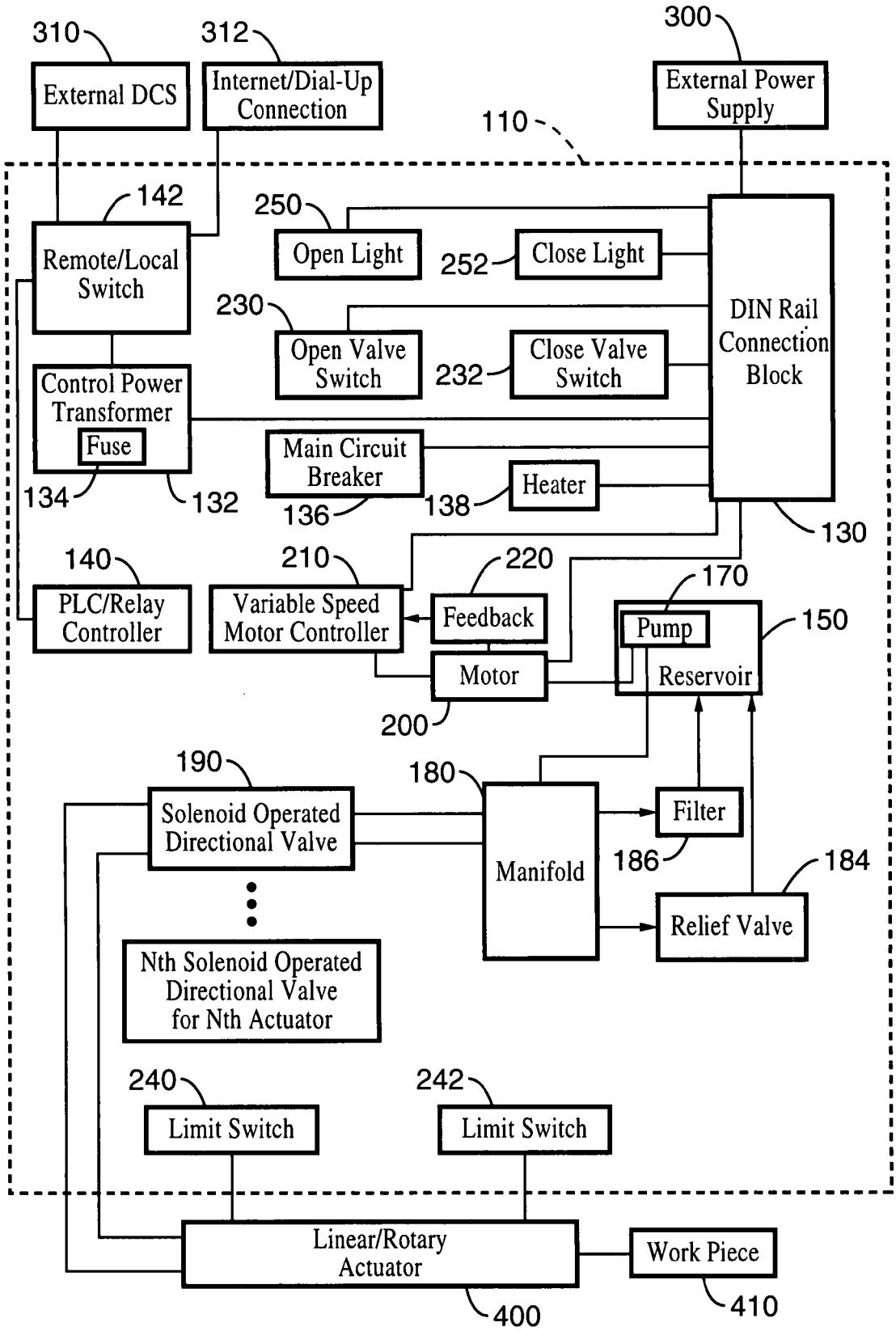
FIG. 4 is a diagrammatic view of an embodiment of the electronic variable speed (EVS) actuator control system.

Furthermore, and in one embodiment, the EVS actuator control system 110 comprises: a hydraulic pump 170 in fluid delivery communication with the source of hydraulic fluid in the reservoir 150, a hydraulic valve manifold 180, a high pressure hydraulic tube 182 connecting the hydraulic pump 170 to the hydraulic valve manifold 180, a relief valve 184 in communication between the hydraulic valve manifold 180 and the hydraulic reservoir 150, a hydraulic oil return filter 186 in fluid communication with the hydraulic reservoir 150, a high pressure hydraulic tube 188 connecting the hydraulic valve manifold 180 to the hydraulic oil return filter 186 for returning hydraulic oil to the reservoir 150, and a pair of solenoid operated directional control valves 190, 192 in fluid communication with the hydraulic valve manifold 180 and in electrical connection with the relay or PLC electronic system controller 140 via connection block 130 for receiving a fluid flow of hydraulic fluid from the fluid reservoir 150 and allowing fluid flow, upon respective operation of either or both of the solenoid operated directional valves 190, 192 and associated pilot operated check valves 194, 196 shown in FIG. 6, through either or both of the solenoid operated directional valves 190, 192 and out respective ports 1A and 2A disposed in a side of the enclosure 120 as shown in FIG. 3 and then to respective hydraulic actuators 400, 402 and for allowing fluid return of hydraulic fluid from respective hydraulic actuators 400, 402 through either or both of the solenoid operated directional valves 190, 192 by way of respective ports 1B and 2B disposed in the side of the enclosure 120 as shown in FIG. 3 upon respective operation of either or both of the solenoid operated directional valves 190, 192 and associated pilot operated check valves 194, 196.

Moreover, and in one embodiment, the EVS actuator control system 110 is further comprised of: an electric motor 200 operatively coupled to the hydraulic pump 170 via a drive coupling 202 and an adaptor 204 for driving the pump 170 for supplying a pressurized flow of hydraulic fluid from reservoir 150, a variable speed motor controller 210 electrically connected to the electric motor 200 for driving the electric motor at varying speeds and electrically connected to the external main power source 300 via fusses 212 and to system controller 140 via connection block 130. Furthermore, the EVS actuator control system 110 comprises a feedback loop 220 operatively coupled back from the electric motor 200 to the variable speed controller 210 for providing feedback signals correlative to fluid pressure for controlling fluid flow through the solenoid operated directional valves 190, 192 in response to the feedback signals for providing electronic velocity and force control of actuation of high pressure hydraulic linear of rotary actuators such as actuators 400 and 402. Feedback signals from the electric motor 200 may be a function of motor operating current, motor operating voltage, motor operating horsepower, motor operating velocity, motor operating torque and/or motor operating load.

Accordingly, FIG. 6 schematically details out one hydraulic system embodiment of the EVS actuator control system 110 while FIG. 7 schematically details out one electrical system embodiment of EVS actuator control system 110 wherein both will now be evident to those having ordinary skill in the art, informed by the present disclosure.

In use and operation, and referring to the drawings and as outlined in FIG. 5, a control signal is activated by pushing at least one of the front cover mounted push buttons 230, 232, 234, or 236 shown in FIG. 2 and electrically connected to the control system 140 via the connection block 130 or, alternatively, by receiving a command signal from the DCS central control 310. This control signal shifts the associated hydraulic directional control valve 190 or 192 and the associated pilot operated check valve 194 or 196 (FIG. 6) thereby opening the oil flow path to actuate the associated linear or rotary actuator 400 and/or 402 in a specific direction. Simultaneously, the electric variable speed motor controller 210 is actuated turning on the electric drive motor 200 connected to the hydraulic pump 170 creating hydraulic pressure and fluid flow through the associated solenoid operated directional control valve 190 and/or 192 and through the associated pilot operated check valves 194 and/or 196 and to the associated linear or rotary actuator 400 and/or 402 for operating on work piece 410 and/or 412. The motor controller 210 signals the electric drive motor 200 to operate at a programmed speed to generate a specific amount of hydraulic fluid flow for driving the associated linear or rotary actuator 400 and/or 402 controlled by the associated hydraulic directional control valve 190 and/or 192 at the programmed velocity. The motor controller 210 monitors, by way of the closed feedback loop 220, the force (hydraulic pressure) required to move the associated linear or rotary actuator 400 and/or 402 and if the motor controller 210 detects by way of a feed back signal from the closed feedback loop 220 that the force and velocity combination exceeds a predetermined maximum horsepower to move the associated linear or rotary actuator 400 and/or 402 at the programmed velocity, the motor controller 210 then limits the velocity of the associated linear or rotary actuator 400 and/or 402 until the force requirement diminishes and the motor controller 210 can advance the velocity of the associated linear or rotary actuator 400 and/or 402 to the programmed velocity. System operation stops when the relay or PLC electronic system controller 140 receives a position signal such as from an associated external limit switch 240 or 242 providing feedback that the associated linear or rotary actuator 400 and/or 402 has reached the desired position. This signals the associated hydraulic directional control valve 190 and/or 192 to shift into the closed position and signals the motor controller 210 to stop the electric drive motor 200 which in turns stops the hydraulic pump 170. The associated pilot operated check valve 194 and/or 196 shifts and locks the oil in the associated linear or rotary actuator 400 and/or 402 preventing the associated linear or rotary actuator from movement until hydraulic pressure is generated by the electric drive motor 200 driving the hydraulic pump 170 and generating hydraulic flow and pressure to the associated hydraulic directional control valve 190 and/or 192.

Additionally, and in use and operation, the EVS actuator control system 110 can control multiple hydraulic actuator operations simultaneously and adjust the speed of the electric motor 200 driving the hydraulic pump 170 to generate the hydraulic flow required for multiple actuations based on customer requirements. Hence, the EVS actuator control system 110 can operate on one or many high-pressure hydraulic linear and/or rotary actuators on different pieces of hydraulically driven equipment and with different velocity requirements actuating in different directions.

Furthermore, and in use and operation, the EVS actuator control system 110 can be set for maximum electrical current, which will limit the output torque of the electric drive motor 200 driving the hydraulic pump 170. This in turn limits the hydraulic pressure output of the hydraulic pump, which provides the force to the rotary or linear actuator. Furthermore, the EVS actuator control system 110 can operate the hydraulic rotary or linear actuator at a preset or variable velocity based on customer requirements. Should the actuation require more power than the electric motor can supply at a given velocity the EVS actuator control system 110 can reduce the velocity or the actuation to maintain the maximum horsepower the EVS actuator control system 110 has been programmed to generate.

Hence, one advantage of the EVS actuator control system 110 is that the electric drive motor 200 driving the hydraulic pump 170 can intermittently operate at higher electric motor speed at lower force providing more hydraulic flow and faster operating velocity to the hydraulic actuator when the force requirement is low. This is an advantage when opening or closing an actuator that has different force requirements as the rotary or linear actuator proceeds through the operating cycle.

For example, envision a hydraulic trash compactor where the velocity of a compaction actuator can be fast until the actuator meets the trash and then the actuator operation slows as the "squeeze" part of the actuation requires more force and less velocity. The EVS actuator control system 110 controls this rather than requiring traditionally more costly methods using high-low hydraulic pumps, pressure compensated hydraulic pumps or sophisticated hydraulic valves.

Moreover, and in use and operation, lights 250, 252, 254, and 256 are mounted on the cover 126 of the enclosure 120 and are electrically connected to the system controller 140 via connection block 130 for being electrically associated with respective cover mounted push buttons 230, 232, 234, and 236 such that each light 250, 252, 254, and 256 is illuminated upon respective activation of each cover mounted push button 230, 232, 234, and 236.

Additionally, a motor run light 258 as shown in FIG. 2 is electrically connected to the system controller 140 via connection block 130 for being illuminated upon running of the motor 200. Fault light 164 is electrically connected to the system controller 140 via connection block 130 and is illuminated when an operational fault has occurred. Furthermore, the EVS actuator control system 110 can transmit fault information to a DCS central control. Moreover, an emergency stop switch 260 is electrically connected to the connection block 130 for actuating an emergency stop of the EVS actuator control system 110.

Accordingly, it should be apparent that further numerous structural modifications and adaptations may be resorted to without departing from the scope and fair meaning of the present invention as set forth hereinabove and as described herein below by the claims.

We claim:

1. An actuator control system, comprising:

a source of hydraulic fluid;

a pump in fluid delivery communication with said source of hydraulic fluid;

an electric motor operatively coupled to said pump for driving said pump for supplying a pressured fluid flow of hydraulic fluid from said source of hydraulic fluid;

a solenoid operated directional valve in fluid delivery communication with said pump for receiving said pressurized fluid flow of hydraulic fluid supplied from said pump and allowing said pressurized fluid flow through said solenoid operated directional valve upon operation thereof;

a hydraulic actuator in fluid delivery communication with said pressurized fluid flow through said solenoid operated directional valve for moving a member of said hydraulic actuator at a velocity and force upon operation of said solenoid operated directional valve, wherein said hydraulic actuator is a rotary actuator and said member is a rotary member;

a variable speed controller operatively coupled to said electric motor; and a motor feedback loop operatively coupled from said electric motor to said variable speed controller for providing feedback signals correlative to a pressure of said pressurized fluid flow for driving said member of said hydraulic actuator in response to said feedback signals for providing electronic velocity and force control of actuation of said member of said hydraulic actuator.

2. An actuator control system, comprising:

a reservoir of hydraulic fluid providing a source of hydraulic fluid;

a pump mounted in fluid delivery communication with said source of hydraulic fluid;

an electric motor operatively coupled to said pump for driving said pump for supplying a pressurized flow of hydraulic fluid from said source of hydraulic fluid;

a variable speed controller operatively coupled to said electric motor for driving said electric motor at variable speeds;

a hydraulic actuator in fluid delivery communication with said pump for receiving said pressurized flow of hydraulic fluid from said pump, wherein said hydraulic actuator is a rotary actuator;

a feedback loop operatively coupled from said electric motor to said variable speed controller for providing feedback signals from said motor to said variable speed controller for intermittently driving said motor between a first low torque and high velocity state in response to said feedback signals being correlative to a low load being placed on said hydraulic actuator and a second high torque and low velocity state in response to said feedback signals being correlative to a high load condition being placed on said hydraulic actuator;

a common enclosure enclosing said reservoir, said pump, said electric motor, said variable speed motor controller, and said feedback loop within said common enclosure; and wherein said hydraulic actuator is external to said common enclosure.

* * * * *